United States Patent [19]

Gobert

[11] Patent Number: 4,717,058

[45] Date of Patent: Jan. 5, 1988

[54] CUTTING TOOL FOR CUTTING DIVISIBLE STRIPS OF CONTACT ELEMENTS

[75] Inventor: Bernard Gobert, Montmorency, France

[73] Assignee: Thomas & Betts Corporation, Raritan, N.J.

[21] Appl. No.: 880,385

[22] Filed: Jun. 30, 1986

[30] Foreign Application Priority Data

Aug. 2, 1985 [FR] France ..... 85 11877

[51] Int. Cl.[4] ..... B26F 3/00

[52] U.S. Cl. ..... 225/93; 83/468; 225/96.5; 269/303; 269/307

[58] Field of Search ..... 269/307, 303, 315; 225/93, 96.5, 2; 83/468

[56] References Cited

U.S. PATENT DOCUMENTS

| | | | |
|---|---|---|---|
| 1,745,815 | 2/1930 | Schoepfle | 269/307 X |
| 2,659,950 | 11/1953 | West | 225/93 X |
| 3,142,484 | 7/1964 | Press | 269/303 X |
| 4,160,318 | 7/1979 | Morel | 83/468 X |
| 4,265,154 | 5/1981 | Batson | 83/468 |
| 4,504,003 | 3/1985 | Moody | 225/93 X |
| 4,527,605 | 7/1985 | Ede et al. | 83/468 X |

FOREIGN PATENT DOCUMENTS

| | | |
|---|---|---|
| 0017163 | 10/1980 | European Pat. Off. . |
| 1465479 | 9/1969 | Fed. Rep. of Germany . |
| 2135097 | 12/1972 | France . |

*Primary Examiner*—Frank T. Yost

*Attorney, Agent, or Firm*—Robert M. Rodrick; Salvatore J. Abbruzzese

[57] ABSTRACT

A tool for cutting divisible strips of frangible material having pre-break lines disposed at predetermined spacings comprises an elongate channel support within which a slider captively slides. The support is adapted to receive a divisible strip therein through an open end thereof. The slider has a surface define a stop against which the strip will strike. The support has along its side walls, a series of markings arranged at predetermined pitches corresponding to whole numbers of unit spacings of the break lines between the stop on the slider and the open end face of the support. The support further includes locking means that resilient lock the slider at the positions of the markings such that by sliding the slider to one of the selected markings variously sized strips can be obtained by breaking the strips by a lateral pressure applied thereto against the end face of the support.

6 Claims, 4 Drawing Figures

CUTTING TOOL FOR CUTTING DIVISIBLE STRIPS OF CONTACT ELEMENTS

FIELD OF THE INVENTION

The present invention relates to a cutting tool for cutting divisible strips into a given number of elements, these strips being formed from an insulating base made from a frangible material supporting contact elements separated by pre-break lines on the base situated at unit spacings of constant pitch.

BACKGROUND OF THE INVENTION

The elements may be, for example, male contact pins, or female elements, a well defined quantity of which may be intended for simultaneous fitting in series in a single block on a support, for example a printed circuit card.

The elements presently used are of very small size and their number may be of the order of sixty or more per strip, with pitches on the order of 2.54 mm. When it is desired to obtain, from such strips, a series comprising a given number of contact elements in a single block, they must be counted one by one up to the desired number, then the strip must be broken at the position thus reached, by a bending movement of the base, at the level of the corresponding pre-break line.

This procedure has essentially three drawbacks:

a. The operation consisting in counting the elements one by one is long and tedious, especially when it is repeated numerous times;

b. The risk of error with respect to the number of elements in the series obtained is high; and c. It is not always easy to break the strip by bending at the chosen position.

SUMMARY OF THE INVENTION

The object of the present invention is to overcome all these drawbacks of the present technique and to provide a tool allowing a selected series to be obtained, easily, rapidly and without the risk of error, comprising a given number of contct elements in a single block, from divisible strips comprising any number of such elements.

For this, a tool in accordance with the present invention comprises a linear support; a slider adapted for moving in both directions on the support; locking means for resiliently locking the slider in given discrete positions on the support, the spacing of these positions being approximately the same as that of said pre-break lines on the contact elements; at least a first longitudinal slide one end of which opens in a first front end face of the support and the other end of which is limited by a stop integral with said slider, this slide having a cross section of a shape to receive the strips by sliding with clearance; and a graduation extending along the slide, formed of marks providing an indication of the whole number of unit spacings between the first front end face of the support and the stop integral with the slider, for each discrete locking position thereof on the support.

Such a tool allows the desired object to be attained readily. To obtain a series of a given number of contact elements, it will be sufficient:

1. To position the slider at the discrete position chosen, so that its stop comes opposite that of the marks of the graduation which corresponds to said given number;

2. To engage a strip in the longitudinal slide of the support, until its end comes up against said stop integral with the slider;

3. To break the strip by bending the projecting part at the level of said front end face of the support, the edge formed on this face by the outlet of the slide serving as fulcrum for bending; and 4. To remove from the slide the series of contact elements thus obtained, which then contains the given number of elements.

This operation may be repeated rapidly, without fatigue for the operator, and with a very low error risk.

It will be readily understood that this tool is very time saving with respect to the time required by the operation of the prior technique. This time saving is even more evident when it is desired to obtain numerous series of contact elements all comprising the same number of elements, since in this case there will be no need to operate the slider since the number of elements remains unchanged.

Advantageously, a cutting tool in accordance with the invention is further characterized in that the support comprises a second longitudinal slide, having a cross section different in shape from that of the first slide, for receiving another type of strip.

The different types of strips may be distinguished from example by different standardized widths of their base and, in this case of course, the first and second slides will have different widths each adapted to a standardized width of base.

In the case of such a support comprising two slides, it will be further advantageous for the second slide to extend substantially in the extension of the first one and to open in a second front face, opposite the first face, of the support, the slider being then integral with two opposite stops for limiting respectively the first slide and the second slide.

These arrangements allow manufacture of the tool to be simplified.

It is also advantageous to provide for a stop integral with the slider to be formed by an extension of its front face, which extends into the corresponding slide.

Thus, the stop of the slider may only come into contact with the base at the level of the end of the strips introduced into the slide, so that the contact pins do no risk being bent by coming into contact with the stop of the slider.

A tool of the invention may again advantageously be characterized in that the cross section of the slide or slides has a form such that the strips may slide therein wihtout being able to escape laterally therefrom. This arrangement is useful so that the strip remains in position in the tool, particularly during the operations 2 and 3 referenced hereinabove.

Moreover, it will be also advantageous for the locking means to be of a resilient return type and comprise, for example, at least one ball movable in a housing of the slider and urged by a spring for selective engagement in the cups of a range of cups, provided on said support at positions whose pitch is the same as that of said pre-break lines.

Locking the slider alaong the support, at each of the given discrete positions, will thus be provided automatically without additional handling, whenever the slider is pushed in one direction or the other along the support.

One embodiment of the invention will now be described by way of example which is not limitative with reference to the accompanying Figures.

DETAILED DESCRIPTION OF THE PREFERRED EMBODIMENTS

Figure 4:
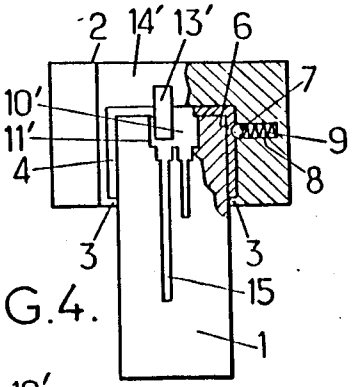
FIG. 4 is an end view of the tool, with partial cross section of the slider, through line IV—IV of FIG. 2.

In the drawing FIGS. 1–4, there is shown a linear support 1 having a general shape of a rectangular parallelpiped with narrow base, forming the main part of the tool and a slider 2 which is mounted so as to be able to slide in both directions along support 1. So that the slider cannot escape laterally from the support, it has at its lower part two flanges 3 directed towards each other which are retained by abutment under the lower edges of two inverted, L-shaped brackets 4, which are fixed by screws 5 to the two upper side edges of support 1.

Slider 2 is intended to move by increments over support 1.

For this, resilient return locking means are provided between slider 2 and at least one of the brackets 4, which comprises laetrally a continuous row of equidistant cups 6, this row extending substantially from one end to the other of support 1. These locking means comprise a ball 7 movably mounted in a cylindrical housing 8 in slider 2 and urged permanently by a compression spring 9 towards the side face of the bracket considered, at the level of the row of cups 6.

Thus, when slider 2 is pushed in one direction or in the other along the support, it is locked resiliently and successively at discrete equidistant positions on support 1, going from one end to the other thereof. The pitch of these discrete positions which slider 2 may occupy selectively and which corresponds to the relative spacing between cups 6 may be, for example, 2.54 mm.

Support 1 comprises a longitudinal slide in the shape of a narrow channel 10 one end of which opens through an opening 11 in a front end face 12 of support 1. This slide is defined, at its other end, by a stop 13 integral with slider 2. This stop 13 is formed by an extension of the front face 14 of the slider extending into channel 10.

Figure 3:
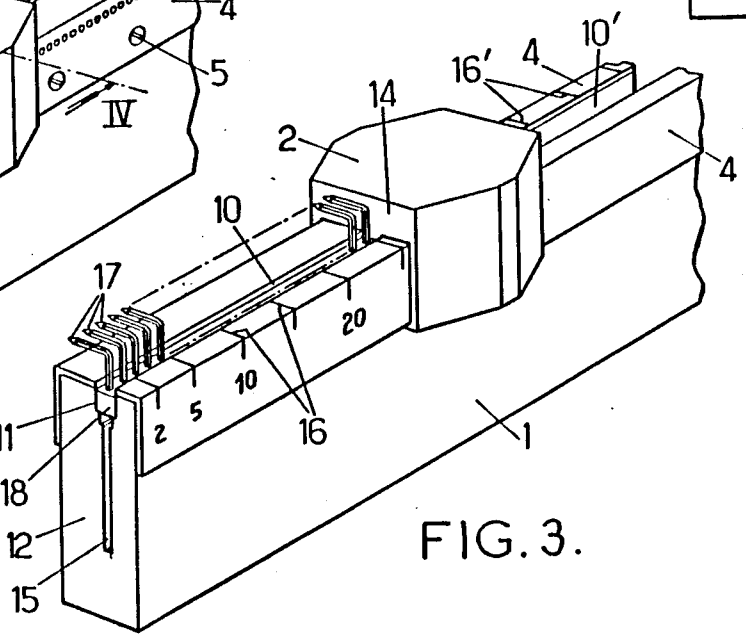
FIGS. 2 and 3 are partial perspective views of the tool, seen respectively from the wide slide side and from the narrow slide side.

As can be clearly seen in FIG. 3, the horizontal flange of the two brackets 4 projects slightly inside channel 10, with respect to the side walls thereof, so that a strip having a same width as this channel (except for clearances) may be retained therein without being able to escape therefrom upwardly.

It should also be noted that in the bottom of the channel shaped slide 10 there opens a slit 15 which may serve for passing contact stems or pins of the strips.

The right hand bracket 4 (considering the front end of the tool shown in FIG. 3) has along the edge of slide 10 a graduation formed of marks 16 similar to those of a rule and a part at least of which are associated with reference numbers such as 2, 5, 10, 20 etc., the (virtual) zero of this graduation being situated in the plane of the front face 12 of support 1.

This graduation has a unit of length equal to the pitch of the successive discrete positions which slider 2 may occupy, i.e. 2.54 mm in the case of hte example chosen above, so that reading the graduation at the level of the front face 14 of the slider (whose plane coincides with the surface of stop 13) immediately gives for each discrete position of the slider, and without any counting, the indication of the whole number of unit spacings between said front space 12 of the support and said stop 13 of the slider.

A tool in accordance with the invention may comprise several parallel slides or channels for example of different lengths, for receiving strips whose isolating bases would have corresponding widths.

Figure 1:
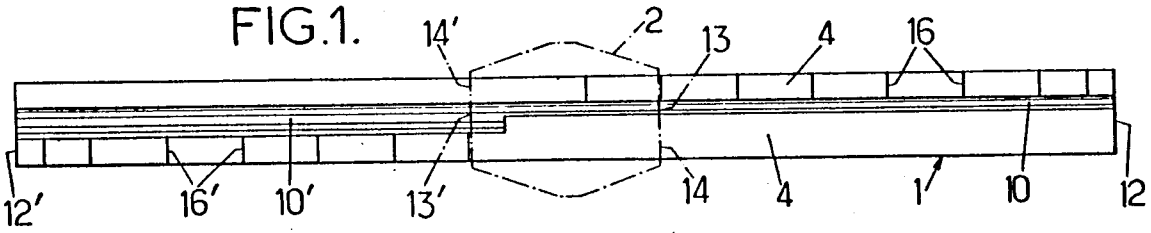
FIG. 1 is a top view of a tool according to the present invention, comprising a first wide slide and second narrow slide.
Figure 2:
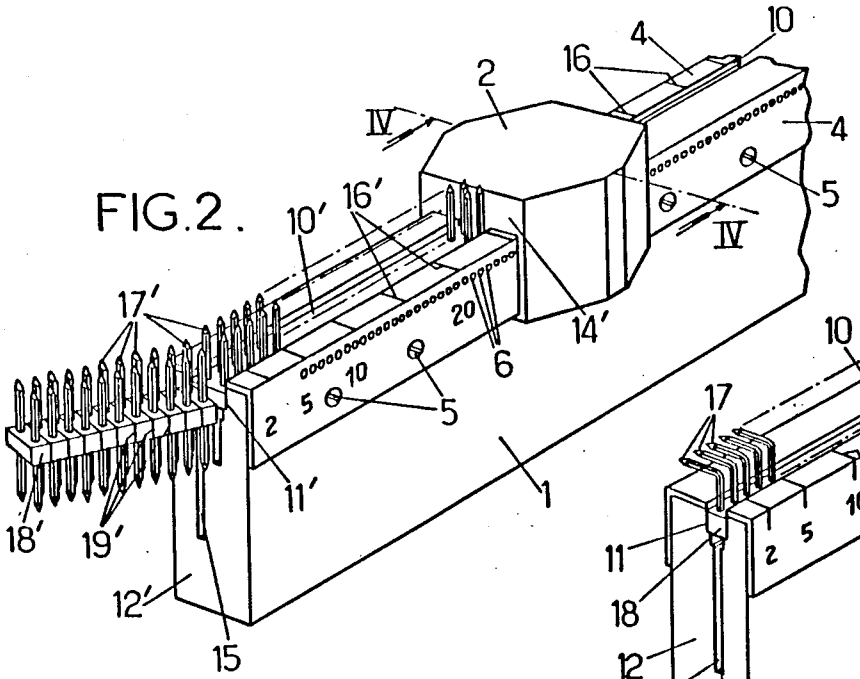

As has been shown in FIGS. 1 to 3, the tool may comprise only two slides, 10 and 10′ of substantially equal lengths, disposed substantially in the full extension of each other and opening into the two opposite front faces 12 and 12′ of support 1. The slider 10′ is shown of a width approximately twice that of slide 10, for receiving, for example, double row contact strips similar to the one shown in FIG. 2.

This second slide 10′, apart from this difference of width, is similar to slide 10 and cooperates in the same way with slider 2, which comprises for this purpose a second stop 13′ similar to stop 13, but situated in the plane of the opposite front face 14′ of the slider. Similarly, also, the other bracket 4 comprises along slide 10′ a graduation formed of marks 16′, similar to marks 16 and having the same purpose.

In FIG. 2, use is shown of the tool which has just been described for breaking a strip comprising a double row of contacts whose pins have been referenced 17′ and are carried by an insulating base 18′. This base is made from a frangible material, preferably from a synthetic material and comprises, between the successive pairs of pins 17′, equidistant pre-break lines 19′. The constant distances which separate two successive lines 19′ form what has been called above "unit spacings" and are therefore, in the example chose, equal to 2.54 mm.

Hence, if it is desired for example to obtain a series of 26 contact elements, i.e. 26 pairs of pins 17′ in a single block, slider 2 is placed in the position (26) shown in FIG. 2, and a double strip (comprising for example 60 pairs of pins) is introduced into slide 10′, by sliding it through opening 11′, until its end is stopped by stop 13′. Then, a flexure force is exerted laterally on the projecting part of the strip, until it breaks, which is effected by pressing against the edge of opening 11′ at the level of the corresponding pre-break line 19′. It is then sufficient to remove from the tool the remaining strip section which then comprises, as desired, a series of 26 pairs of pins in a single block.

The procedure is the same for a strip 17–18 comprising a single row of contacts, using slide 10, as shown in FIG. 3.

It has also been shown in this Figure that the strips may be of any type and comprise for example pins 17 bent at right angles.

A tool in accordance with the invention may be made from any appropriate material, for example from metal or a molded plastic material. In this latter case, brackets 4 could be integral with support 1, instead of being formed of separate parts. The means for locking slider 2 on support 1 could also be very different from those which have been described above, and could for example comprise a ratchet system or similar mechanism which could be outside the slider.

As is evident and as it follows from the description herein, the invention is illustrative and not limited to those embodiments which have been more particularly described. As such, the invention embraces all variants thereof. The true scope of the invention is set forth in the appended claims.

I claim:

1. A cutting tool for cutting divisible strips into a given number of elements, these strips being formed form an insulating base (18, 18') made from a frangible material carrying contact elements (17, 17') separated by pre-break lines (19, 19') on the base situated at unit spacings of substantially constant pitch, comprising: a linear support (1); a slider (2) adapted for moving in both directions on the support; locking means (6 to 9) for resiliently locking the slider (2) in given discrete positions on the support (1), the pitch of these positions being approximately the same as that of said pre-break lines; at least one longitudinal slide (10) one end of which opens into a first front end face (12) of the support (1) and the other end of which is limited by a stop (13) integral with said slider (2), this slide (10) having a cross section of a shape such to receive said strips by sliding with clearance; and a graduation extending along said slide (10), formed of marks (16) for giving an indication of the whole number of unit spacings between said first front end face (12) of the support (1) and said stop (13) integral with the slider (2), for each discrete locking position thereof on the support (1), said support (1) comprising a second longitudinal slide (10'), having a cross section of a shape different from that of the first slide (10), for receiving another type of strip, said second slide (10') extending substantially in the extension of the first slide (10), and opening into a second front face (12'), opposite the first face (12), of said support (1).

2. A tool according to claim 1, wherein said slider (2) is integral with two opposite stops (13, 13') for limiting respectively the first slide (10) and the scond slide (10').

3. A tool according to claim 1, wherein a stop (13 or 13') integral with the slider (2) is formed by an extension of its front face (14 or 14'), which extends into the corresponding slide (10 or 10').

4. A tool according to claim 1, wherein the cross section of the slide (10 or 10') has a shape such that the slider may slide therein without being able to escape laterally therefrom.

5. A tool according to claim 1, wherein said locking means (5 to 9) are of a resilient return type.

6. A tool according to claim 5, characterized in that said locking means (6 to 9) comprises at least one ball (7) movable in a housing (8) of the slider (2) and is urged by a spring (9) for selective engagement in cups (6) of a row of cups provided on said support (1), at positions whose pitch is approximately the same as that of said pre-break lines.

* * * * *